US005727984A

United States Patent [19]

Lin

[11] Patent Number: 5,727,984

[45] Date of Patent: Mar. 17, 1998

[54] ROLLING TOY

[76] Inventor: Kuo Jung Lin, No. 100, Lane 175, Cheng Kung Road, Tainan, Taiwan

[21] Appl. No.: 774,438

[22] Filed: Dec. 30, 1996

[30] Foreign Application Priority Data

Apr. 17, 1996 [TW] Taiwan ..... 85205518

[51] Int. Cl.[6] ..... A63B 39/00; A63B 43/00; A63B 67/10

[52] U.S. Cl. ..... 446/431; 446/368; 446/486; 473/576

[58] Field of Search ..... 446/431, 486, 446/368; 473/576

[56] References Cited

U.S. PATENT DOCUMENTS

| | | | |
|---|---|---|---|
| 559,293 | 4/1896 | Kitchen | 446/368 |
| 4,248,435 | 2/1981 | Barmore | 273/331 |
| 4,249,333 | 2/1981 | Chase et al. | 446/486 |
| 4,505,687 | 3/1985 | Munro | 446/368 |

OTHER PUBLICATIONS

"Slinky Worm", Playthings, vol. 56, No. 3, p. 310, Mar. 1958.

D.Y.Toys brochure, "Weazel Ball," Playthings, Feb. 1996.

*Primary Examiner*—Michael A. Brown
*Assistant Examiner*—Laura Fossum
*Attorney, Agent, or Firm*—Bacon & Thomas

[57] ABSTRACT

A rolling toy comprises a ball, an expandable coil, and a connecting device connected to the ball and the expandable coil. The ball has a first semispherical shell and a second semispherical shell engaging with the first semispherical shell. A hole is formed in the ball. An aperture is formed in a front end of the expandable coil. The connecting device has a rod, a plate and a block. The connecting device is made of a flexible material. The length of the plate is larger than the diameter of the hole. The length of the block is larger than the diameter of the aperture. The rod has a first end connected to the plate and a second end connected to the block. The plate is folded and inserted in the hole. The block is folded and inserted in the aperture.

1 Claim, 2 Drawing Sheets

ROLLING TOY

BACKGROUND OF THE INVENTION

The present invention relates to a rolling toy. More particularly, the present invention relates to a rolling toy which has a ball and an expandable coil which chases the ball.

A conventional rolling ball has a plurality of gears in the ball. The gears drive a rolling toy or a plurality of rolling toys on the ball. However, it is cumbersome to assemble the gears in the ball.

SUMMARY OF THE INVENTION

An object of the present invention is to provide a rolling toy which has a ball and an expandable coil which chases the ball.

Accordingly, a rolling toy comprises a ball, an expandable coil, and a connecting device connected to the ball and the expandable coil. The ball has a first semispherical shell and a second semispherical shell engaging with the first semispherical shell. A hole is formed on the ball. An aperture is formed on a front end of the expandable coil. The connecting device has a rod, a plate and a block. The connecting device is made of a flexible material. The length of the plate is larger than a bore of the hole. The length of the block is larger than a bore of the aperture. The rod has a first end connected to the plate and a second end connected to the block. The plate is folded and inserted in the hole. The block is folded and inserted in the aperture. Since the plate and the block are made of flexible material, the plate and the block will recover their original shapes after passing through the corresponding hole and the corresponding aperture and respectively secured thereto.

DETAILED DESCRIPTION OF THE INVENTION

Figure 1:
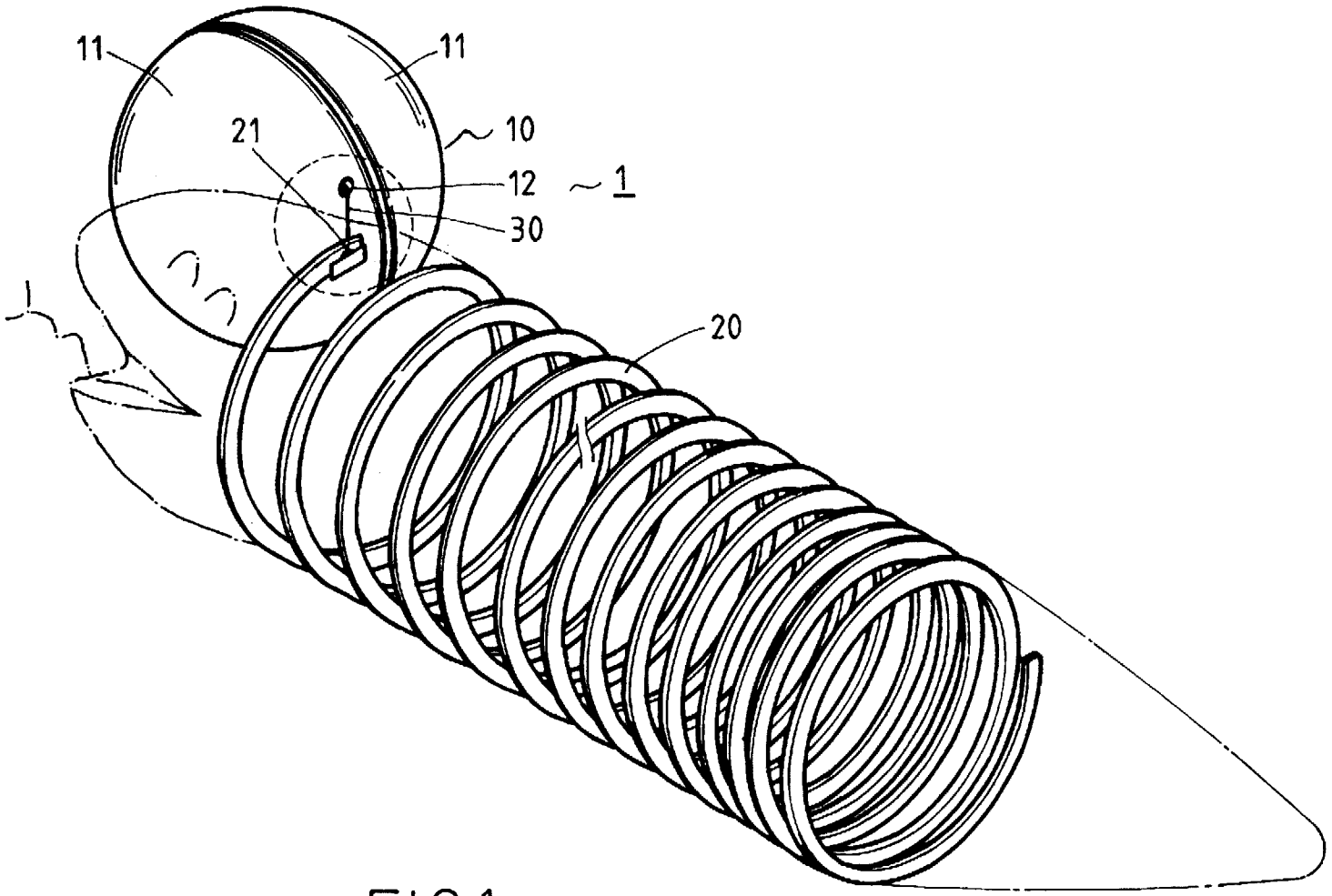
FIG. 1 is a perspective assembly view of a rolling toy according to a preferred embodiment of the present invention.
Figure 3:
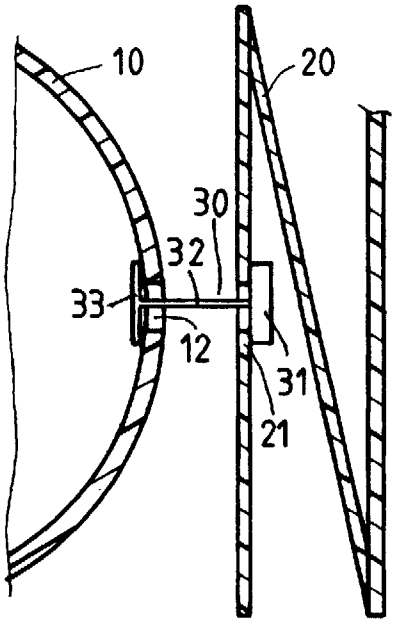
FIG. 3 is a partial sectional view of a rolling toy of the preferred embodiment of the present invention.
Figure 2:
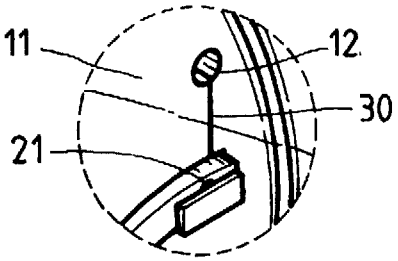
FIG. 2 is a partially enlarged view of a connecting device.

Referring to FIGS. 1 to 3, a rolling toy 1 comprises a ball 10, an expandable coil 20, and a connecting device 30 connected to the ball 10 and the expandable coil 20.

The ball 10 has a first semispherical shell 11 and a second semispherical shell 11 engaging with the first semispherical shell 11. A hole 12 is formed in the ball 10.

An aperture 21 is formed in a front end of the expandable coil 20.

The connecting device 30 has a rod 32, a plate 33 and a block 31. The connecting device 30 is made of a flexible material. The length of the plate 33 is larger than the diameter of the hole 12. The length of the block 31 is larger than the diameter of the aperture 21. The rod 32 has a first end connected to the plate 33 and a second end connected to the block 31. The plate 33 is folded and inserted through the hole 12. The block 31 is folded and inserted in the aperture 21. Since the plate 33 and the block 31 are made of the flexible material, the plate 33 and the block 31 will recover their original shapes after passing through the corresponding hole 12 and the corresponding aperture 21 and be secured, respectively, to the ball 10 and the coil 20.

Figure 4:
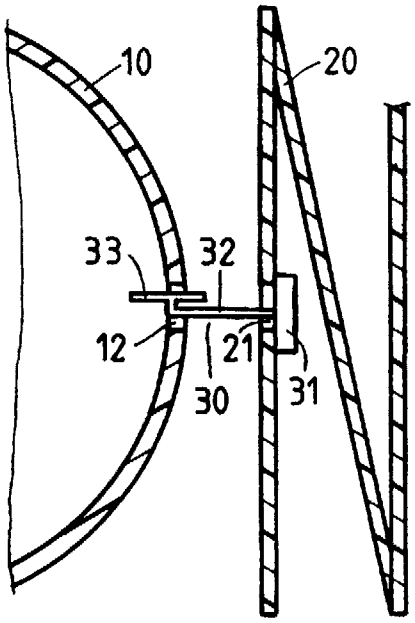
FIG. 4 is a partial sectional view illustrating insertion of the plate within the hole of the ball.

Referring to FIG. 4, the expandable coil 20 chases the ball 10 while the ball 10 is rolling.

The invention is not limited to the above embodiment but various modification thereof may be made. Further, various changes in form and detail may be made without departing from the scope of the invention.

I claim:

1. A rolling toy comprising;

a ball, an expandable coil, and a connecting device connected to the ball and the expandable coil, the ball having a first semispherical shell and a second semispherical shell engaging with the first semispherical shell, a hole formed in the ball, an aperture formed in a front end of the expandable coil, the connecting device having a rod, a plate and a block, and the connecting device being made of a flexible material, the plate having a length that is larger than the diameter of the hole, the block having a length that is larger than the diameter of the aperture, the rod having a first end connected to the plate and a second end connected to the block, the plate being foldable and inserted in the hole, the block being foldable and inserted in the aperture.

* * * * *